US005150017A

United States Patent [19]

Geens et al.

[11] Patent Number: 5,150,017

[45] Date of Patent: Sep. 22, 1992

[54] HIGH PRESSURE SODIUM DISCHARGE LAMP

[75] Inventors: Rudy E. A. Geens, Leuven, Belgium; Elliot F. Wyner, Peabody, Mass.

[73] Assignees: GTE Products Corporation, Danvers, Mass.; GTE Sylvania N.V., Tienen, Belgium

[21] Appl. No.: 722,024

[22] Filed: Jun. 27, 1991

[51] Int. Cl.[5] ..... H05B 41/00

[52] U.S. Cl. ..... 315/326; 315/358; 313/565; 313/571; 313/639; 313/642

[58] Field of Search ..... 313/565, 570, 571, 572, 313/624, 625, 639, 640, 641, 642; 315/326, 358

[56] References Cited

U.S. PATENT DOCUMENTS 4,755,721 7/1988 Okada et al. ..... 313/571

5,001,396 3/1991 Snellgrove et al. ..... 313/625

*Primary Examiner*—Eugene R. LaRoche
*Assistant Examiner*—Michael B. Shingleton
*Attorney, Agent, or Firm*—Robert E. Walter

[57] ABSTRACT

A high pressure sodium lamp having a fill within an elongated arc tube comprising an inert starting gas, mercury and sodium wherein said mercury and sodium being are in an amount less than two milligrams per cubic centimeter of said volume of the interior of the arc tube wherein the weight ratio of sodium to mercury is less than 1 to 20 whereby the lamp is saturated with sodium and unsaturated with mercury at said predetermined nominal output voltage and does not extinguish at an input voltage exceeding about 90 percent of said rated voltage.

9 Claims, 10 Drawing Sheets

| $I_{la}$ | 1.0 | .85 | .70 | .55 | .40 |
|---|---|---|---|---|---|
| VO | 2.8 | -.2 | 3.6 | 6.3 | 22 |
| b | 3.0 | 3.4 | 3.4 | 3.5 | 3.2 |
| R2 | .99 | .97 | 95. | .96 | .98 |

HIGH PRESSURE SODIUM DISCHARGE LAMP

FIELD OF THE INVENTION

The present invention relates to high pressure sodium vapor discharge lamps and more particularly to types that use a starting gas and have sodium and mercury inside the arc tube so that in an operating lamp a gas mixture of sodium, mercury and starting gas is present.

BACKGROUND OF THE INVENTION

High pressure sodium discharge lamps with saturated sodium/mercury amalgam fills are known to the art. These lamps are overdosed so that a liquid amalgam pool remains in the lamp during operation and the sodium and mercury pressures in the arc are regulated by the temperature of the coldest spot in the arc tube. Current lamp design prescribes the use of very highly overdosed amalgam pills. During the lamp life the lamp voltage of such lamps will slowly rise and eventually lead to extinction when the lamp voltage exceeds the available main voltage. Two reasons for this voltage rise can be identified.

Firstly, the highly overdosed pills supply ample sodium in the arc tube so that the loss of sodium from the arc due to chemical reactions can be compensated. However, this compensation is only partial, since as the sodium fraction in the liquid decreases, the mercury to sodium ratio in the vapor rises. Since mercury serves as a buffer gas to raise the lamp voltage, the latter effect will induce lamp voltage rise together with sodium pressure drop.

Secondly, emitter material is lost from the electrodes due to evaporation and sputtering. This leads to less efficient and hotter electrodes and to blackening of the arc tube wall. Both these effects cause the coldest spot temperature to rise. Consequently, the vapor pressure of mercury and sodium above the amalgam will increase, leading again to lamp voltage rise.

A second disadvantage of conventionally overdosed lamps is the lamp voltage instability with input voltage and fixture temperature since both change the coldest spot temperature of the ar tube.

Both voltage instabilities (temporal and thermal) can be limited using unsaturated dosage of the arc tubes. In these lamps the amalgam is completely evaporated during operation so that the gas density becomes independent of the coldest spot temperature and this assures a more stable voltage. Since sodium is highly reactive at the temperatures prevailing in a high pressure sodium lamp, an unsaturated vapor lamp always shows a drop in sodium density, and consequently lamp voltage, during the lamp life. To assure a sufficient sodium density and lamp voltage at the end of the rated life, an unsaturated vapor lamp initially operates at a higher voltage than rated and often at a higher sodium density in the arc than desired for maximum luminous efficiency. The decreasing sodium pressure entails changing luminous flux and color characteristics. The decreasing voltage leads to power and/or current changes according to the ballast on which the lamp is operated. The current technology allows to produce unsaturated vapor type high pressure sodium lamps with sufficiently long life only at rated wattages above 150W. These lamps do exhibit the above-mentioned disadvantages. In low wattage high pressure sodium lamps, the current state of the art can not maintain sufficiently high sodium pressures during the life of a saturated vapor lamp.

High pressure sodium lamps with sodium dosage such that 80 percent or more of the sodium is initially in the vapor state are described in European application 87/302218, which corresponds to U.S. Pat. No. 4,755,721. In these lamps the sodium content is not optimized in any way and the 20 percent or less excess sodium is not intended to compensate for sodium lost from the arc during a significant part of the lamp life. On the contrary, said lamps are described to be a variety of the unsaturated vapor type since they becomes unsaturated fairly early in life.

SUMMARY OF THE INVENTION

It is the object of the present invention to provide an optimized amalgam dosage for a high pressure sodium lamp. It is also an object of the present invention to provide high pressure sodium dosed lamp with improved electrical and luminous stability. It is another object of the present invention to provide a low-wattage, high pressure sodium lamp (lamp power consumption $\leqq$150W) which does not cycle and has a considerably slower drop of sodium pressure and lamp voltage than unsaturated vapor low wattage lamps.

In the present invention, the amalgam pill mass and composition is optimized in order to obtain maximum luminous flux and maximum sodium content under the limitation that the lamp may never cycle. Said dosage allows the lamp to operate saturated in sodium so that excess sodium is available in the lamp and basically unsaturated in mercury so that voltage rise with sodium loss is extremely small. Hence, the normal cycling and attendant voltage rise associated with large amalgam dosages is not present in the lamp of the present invention. Since cold spot temperature rise only increases the sodium vapor pressure and not the mercury vapor pressure, the voltage rise with cold spot temperature is reduced compared to conventional saturated lamps. This reduction gives better voltage stability with changing input voltage, ambient conditions and burning time than conventional saturated lamps. Also, the lamp voltage and sodium pressure do not decrease with burning time as in the case of unsaturated vapor type high pressure sodium lamps. Since this sodium pressure and lamp voltage drop is too severe in unsaturated vapor low-wattage high pressure sodium lamps to hold sufficient values through the whole rated lamp life, the current invention provides a possibility for a low-wattage non-cycling lamp with at least the same useful life as conventional saturated lamps.

In accordance with the present invention, there is provided a high pressure sodium lamp for connection to an electrical power source and having a rated life and comprising an elongated arc tube having a pair of electrodes, each electrode being in sealing relationship with a respective end of said arc tube whereby said arc tube and said electrodes form a volume internal said arc tube, said electrodes forming a discharge path for a high emissive arc, means adapted to connect said electrodes to said power source for generating said arc at an applied wattage and rated voltage, a fill within said elongated arc tube, said fill including an inert starting gas, mercury and sodium, said mercury and sodium being present in an amount less than two milligrams per cubic centimeter of said volume of the interior of said arc tube wherein the weight ratio of sodium to mercury is less than 1 to 20 whereby said lamp is saturated with said sodium and unsaturated with said mercury at said predetermined nominal output voltage whereby said lamp does not extinguish at an input voltage exceeding about 90 percent of said rated voltage.

DESCRIPTION OF THE PREFERRED EMBODIMENTS

Figure 1:
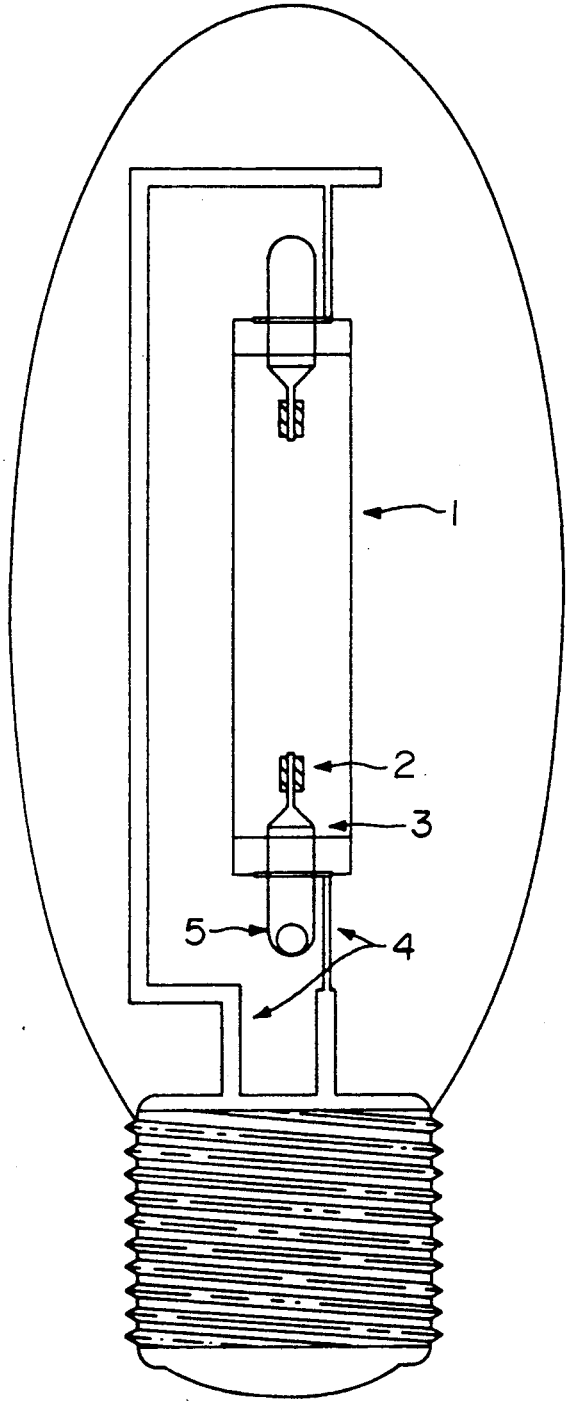
FIG. 1 is a view of a high pressure sodium lamp of the present invention.

As set forth in, FIG. 1, there is provided a high pressure sodium vapor discharge device comprising a sodium resistant arc tube 1 having a fill including sodium and mercury 5; and a pair of electrodes, 2 welded to niobium tubes 3 which are sealed through opposite ends of the arc tube and serve as a reservoir for the amalgam; and a means to connect current 4 to each of the electrodes. Cylindrical polycrystalline alumina arc tubes with an internal length of 51 mm and an internal diameter of 4.0 mm are used. The arc length is 36 mm. The inside of the niobium feedthrough is open towards the arc tube and acts as an external reservoir for the amalgam.

In standard high pressure sodium lamps the percentage by weight of sodium in the sodium/mercury amalgam pill ranges between 12 and 25 percent; the mass of these pills is generally larger than 10 mg. With this dosage, the proportion of sodium to mercury pressure is approximately constant. In accordance with the principles of the present invention, at sodium fractions below 5 percent by weight and pill weights below 2 mg/cc and at temperatures prevailing in an operating lamp, the vapor pressures of sodium and mercury become essentially independent. Hence, under operating conditions, a major portion of the mercury is evaporated while there is still about ⅔ of the sodium in the liquid phase.

A lamp is desirably dosed in such a way that under operating conditions the electrical characteristics are at their nominal values and the luminous efficiency maximized; when the lamp is heated up until all amalgam is evaporated, the maximal lamp voltage is desirably lower than the extinction voltage or the voltage which causes lamp failure. The lamp desirably contains the maximum amount of sodium under the above limitations. This dosage is dependent on the arc tube dimensions and the desired electrical characteristics.

The optimization procedure is described below for the example of a 70W/90V lamp. Making some approximations, a general procedure valid for any polycrystalline alumina arc tube is also generated.

PRINCIPLES AND DETAILED PROCEDURE

Mercury-Sodium Density Relationships

Figure 2:
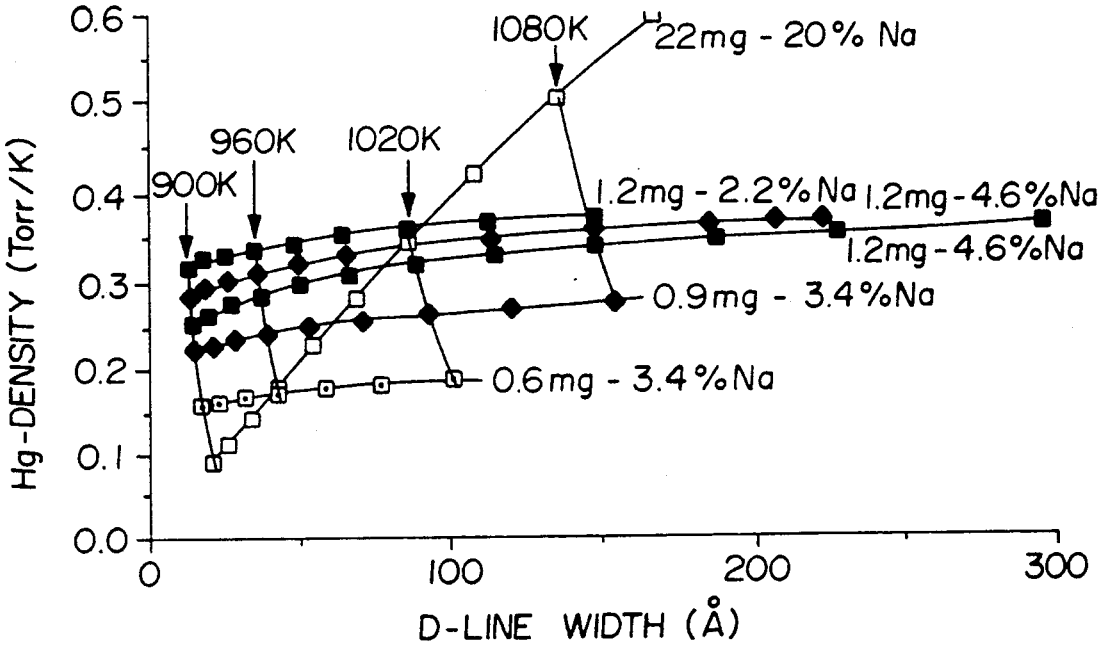
FIG. 2 is a graph of the mercury density versus D-line reversal width in a 70W/90V high pressure sodium lamp for several amalgam pill masses and compositions.

As set forth in Paul A. Reiser and Elliot F. Wyner, J. Appl. Phys. 57(5), 1 Mar. 1985, and with the aid of computer, the mercury density (represented as pressure/arc temperature) is calculated and plotted versus the sodium D-line reversal width (proportional to sodium density) for the case of a 70W/90V high pressure sodium lamp and for different pill masses and compositions. The calculation is made with the following parameters and the results are shown as plotted in FIG. 2:

arc length 36.0:mm;

cavity length 55.5 mm;

arc tube diameter 4.0 mm;

$T_{ew}=-506+1.63$ Tcs, where Tew is the end well temperature (space behind the electrodes) and $T_{cs}$ is the coldest spot temperature;

$T_{arc}=2.4\ T_{ew}$, where $T_{arc}$ is the average temperature

The relationship between $T_{ew}$ and $T_{cs}$ is obtained from cold spot and wall temperatures measurements. The average arc temperature is calculated from a quadratic axial temperature profile with an axis temperature of 4000K. The value used for the cavity length takes into account the external niobium reservoir.

The figure shows that by dropping the conventional sodium fraction in the pill of 20 percent to values in the order of 2 percent to 5 percent, the mercury density becomes essentially independent of the sodium density and is very close to its unsaturated value. The mercury density is mainly determined by the pill mass and less by the sodium fraction in the pill. This allows to choose the pill mass so that approximately the same mercury density as in the conventional lamp (22 mg at 20 percent sodium by weight) is obtained at the D-line width of interest.

Determination of the Amalgam Pill Mass

Figure 3:
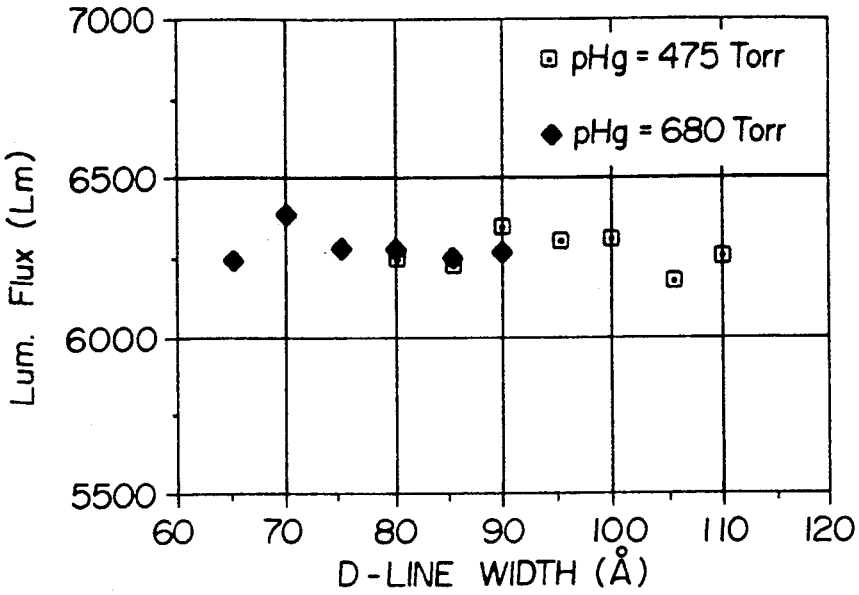
FIG. 3 is a graph of the luminous flux of a set of 70W/90v high pressure sodium lamps as a function of D-line reversal width and for different mercury densities.

FIG. 3 shows the luminous flux of a set of experimental 70W/90V lamps at different D-line width and pill masses (mercury densities). It is clear from the graph that the luminous flux is not strongly dependent on D-line reversal width in the range between 60Å and 120Å. The luminous flux is also known to be fairly independent of mercury density in the range under study here ($5<pHg/pNa<15$).

The D-line may be centered around 90A by adjusting the heat shields and/or the backspace in order to assure that all lamps will have D-line widths that fall in the desired 60–120Å]range. From FIG. 2, it may be observed that a pill of 1.2 mg will have approximately the same mercury pressure at 90 Å as the conventional lamp, assuring the right voltage for the same arc tube configuration and fixing the pill mass for this application.

Empirical Formulation of the Lamp Voltage

The lamp voltage variations with D-line (sodium density in the arc), mercury density and lamp current are experimentally investigated for 70W/90V high pressure sodium lamps. Cylindrical polycrystalline alumina arc tubes with an internal length of 51 mm and an internal diameter of 4.0 mm are used. The arc length is 36 mm. The inside of the niobium feedthrough is open towards the arc tube and acts as an external reservoir for the amalgam as shown in FIG. 1.

Figure 4:
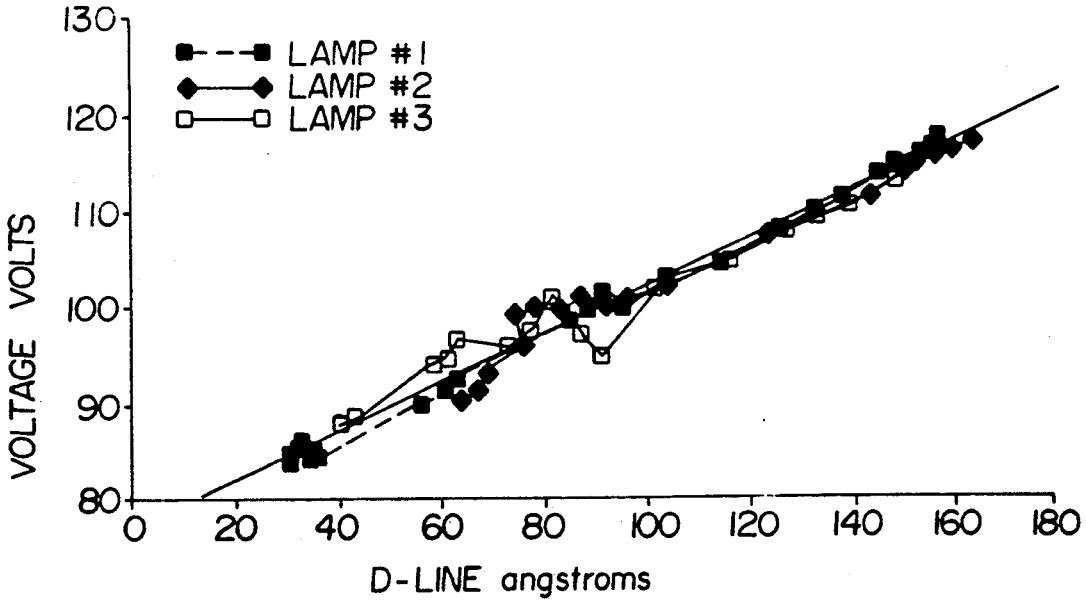
FIG. 4 is a graph of the lamp voltage as a function of sodium D-line reversal width at a constant mercury density of 0.19 Torr/K. The slope is independent of current and equals a =0.007 V/Å (mm).

For unsaturated vapor lamps the voltage variation with D-line at a constant mercury density can be determined since the D-line drops steadily as sodium reacts chemically and disappears from the vapor phase (FIG. 4). The dependence is seen to be approximately linear with a slope of $$a=0.006\pm0.001\,V/(Å mm).$$

Figure 5:
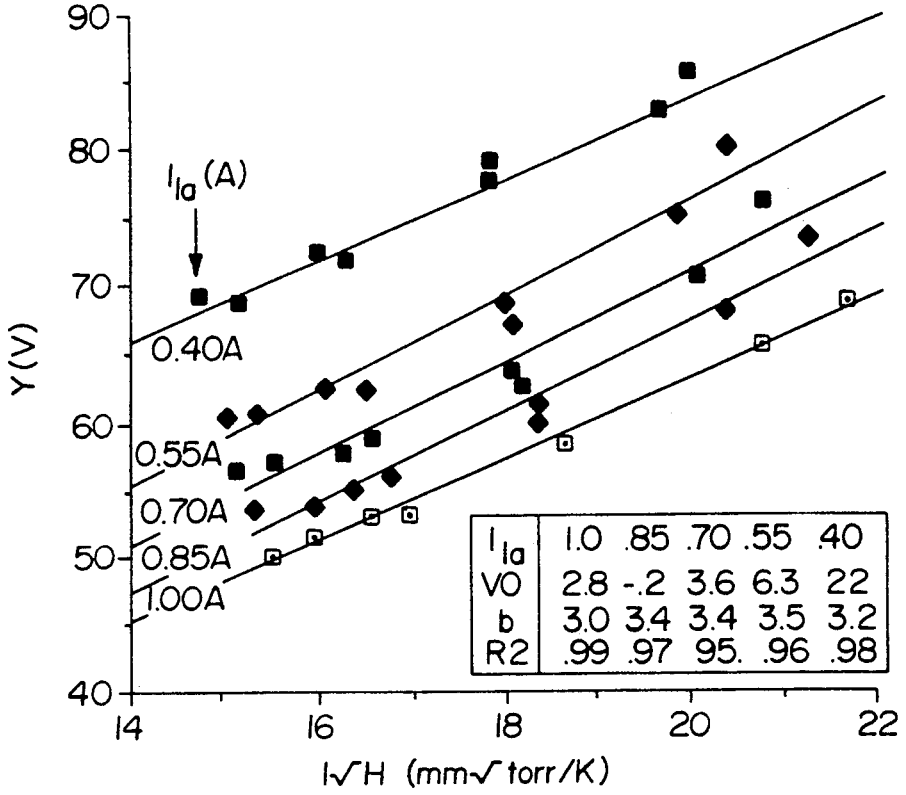
FIG. 5 is a graph describing the sodium-dependent part of the lamp voltage. This voltage $Y=V_{la}-Dal$ ($a=0.007$ V/Å(mm)°, D is the D-line reversal width) is linearly dependent on $1\sqrt{H}$ (1 is the arc length, H is the mercury density). The slope is independent on current; the intercept does have current dependence.

To determine the dependence of the lamp voltage on mercury density, several lamps with pill masses of 0.6, 0.75, 0.9 and 1.2 mg at 3.4 weight percent sodium were measured for voltage and D-line at currents 0.40A, 0.55A, 0.70A, 0.85A and 1.00A. From these values the above-mentioned computer program was used to determine the mercury density H. From the lamp voltages the sodium part of the voltage was subtracted as laD, where D is the D-line reversal width. FIG. 5 shows the graph of $Y=V_{la}-laD$ versus $1\sqrt{H}$ (1 is the arc length) for different values of the lamp current. It is seen that Y depends linearly on $1\sqrt{H}$ the slope is approximately independent of the lamp current and equal to $3.3\pm0.3$ $V/(Torr/K)^{\frac{1}{2}}$. The intercepts of these lines, however, do depend on the current and represent the electrode voltage and the current dependence of the plasma voltage.

Figure 6:
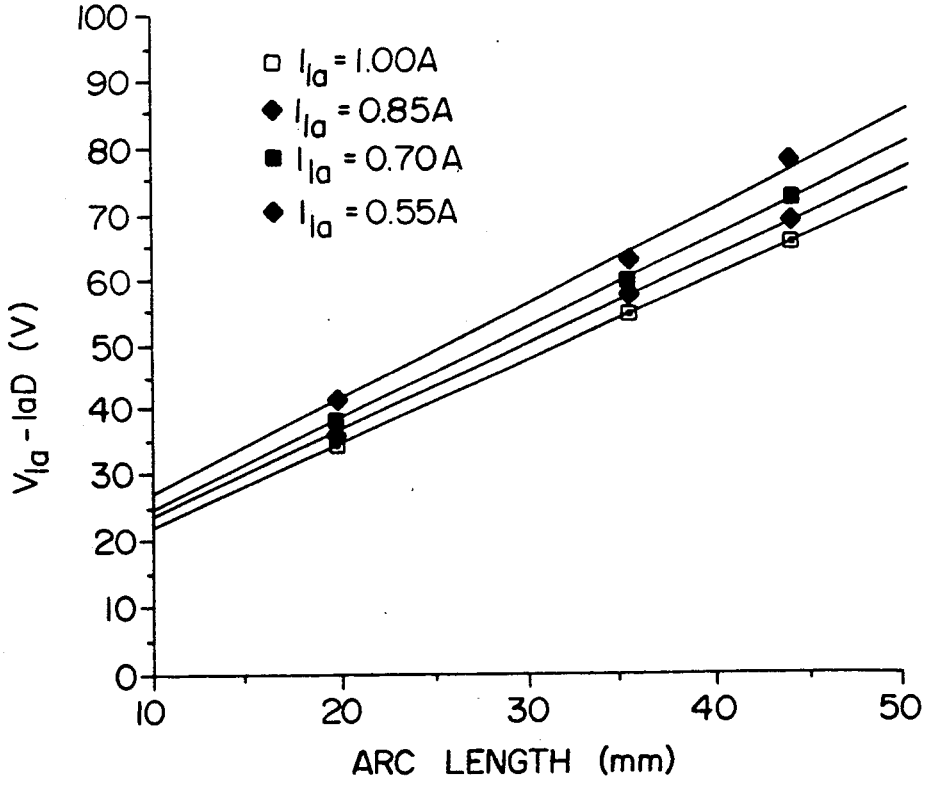
FIG. 6 is a graph of the sodium-independent part of the lamp voltage at an approximately constant mercury density of 0.22 Torr/K versus arc length at different currents. The intercepts give the electrode voltage at the respective currents; the slopes give the electric field in the plasma.
Figure 7:
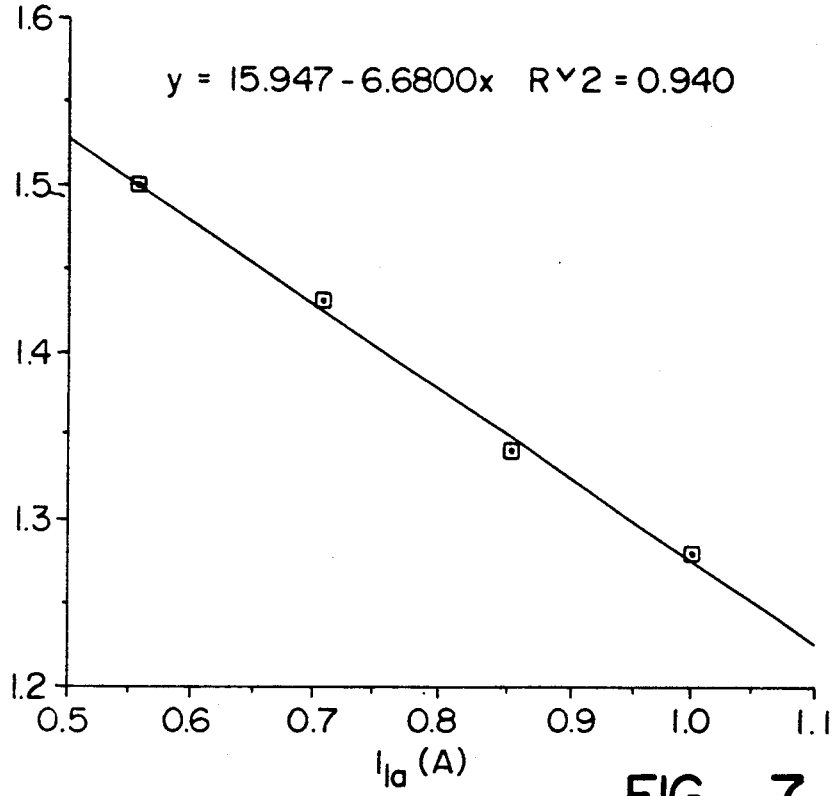
FIG. 7 is a graph of the electrode voltage versus lamp current. For the purpose of interpolation, the relationship is fitted linearly.
Figure 8:
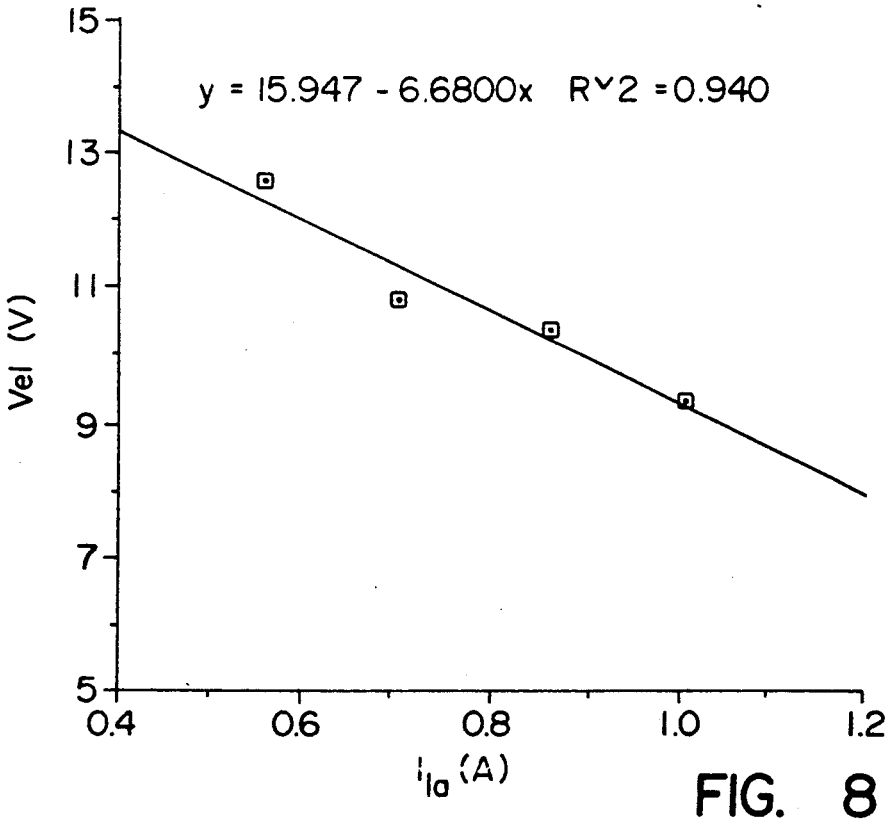
FIG. 8 is a graph of the plasma electric field versus lamp current. For the purpose of interpolation, the relationship is fitted linearly.

In order to separate the electrode and plasma component of these intercepts, arc tubes with different arc lengths (three different PCA tube lengths) and nearly the same mercury densities (average is 0.217 Torr/K, standard deviation is 0.007) were made and measured for voltage and D-line at the same set of lamp currents as above. A plot of $V_{la}-laD$ (FIG. 6) versus arc length at the different currents gives the plasma electric fields (slopes, FIG. 7) and the electrode falls (intercepts, FIG. 8). Both depend approximately linearly on the current in the range studied.

Summarizing, the lamp voltage can be written as:

$$V_{la}=V_{el}+V_{pl}, \tag{1}$$

with the electrode full voltage $$V_{el}=15.9-6.8I_{la} \tag{2}$$

and the plasma column voltage $$V_{pl} = l[0.26 - 0.5\,I_{la} + 3.3\sqrt{H} + 0.007\,D] \tag{3}$$

Determination of Maximum Sodium Content

With the aid of the above-mentioned computer program, the unsaturated ("hot") values of mercury density and sodium density can be calculated. The unsaturated values are the values obtained when all the amalgam is in the vapor phase. This condition is achieved by raising the coldest spot temperature of the arc tube. The values for several dosages can be read from FIG. 2 as the highest D-line reversal width of the corresponding curve.

Figure 9:
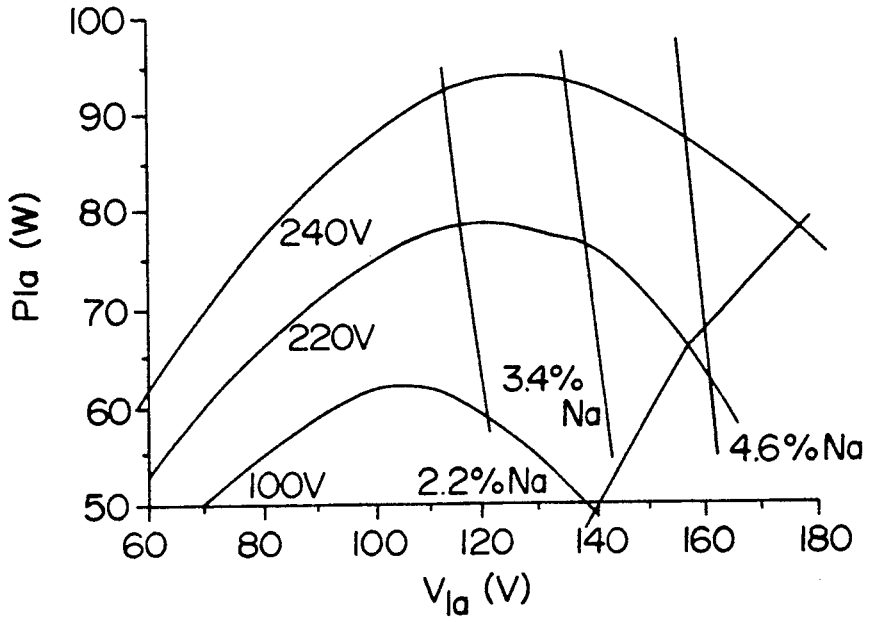
FIG. 9 is a graph of lamp power versus lamp voltage and shows unsaturated lamp lines (lamp lines for the condition where all amalgam is evaporated) for three 1.2 mg pills with 2.2 percent, 3.4 percent and 4.6 percent sodium by weight.

By calculating the lamp voltage according to equation (1) for several lamp currents and assuming a power factor of 0.85, the unsaturated lamp line can be established. This line gives the highest possible voltages of the lamp. In order to keep the lamp from extinguishing and cycling, these lamp voltages must lie below the extinction line. FIG. 9 shows the unsaturated lamp lines for three 1.2 mg amalgam pills with weight percentages of sodium of 2.2 percent, 3.4 percent, and 4.6 percent. The figure shows that for the 70W/90V lamp application with a xenon pressure at ambient temperature of 170 Torr, the 3.4 percent pill is the one with the highest sodium content that will not cause the lamp to extinguish when having an input voltage of at least 90 percent of the rated 220V. Desirably, in accordance with the principles of the present invention, the amalgam dosage of 1.2 mg at 3.4 weight percent of sodium is the desired optimal dosage.

Voltage and Sodium-pressure Maintenance

Figure 10:
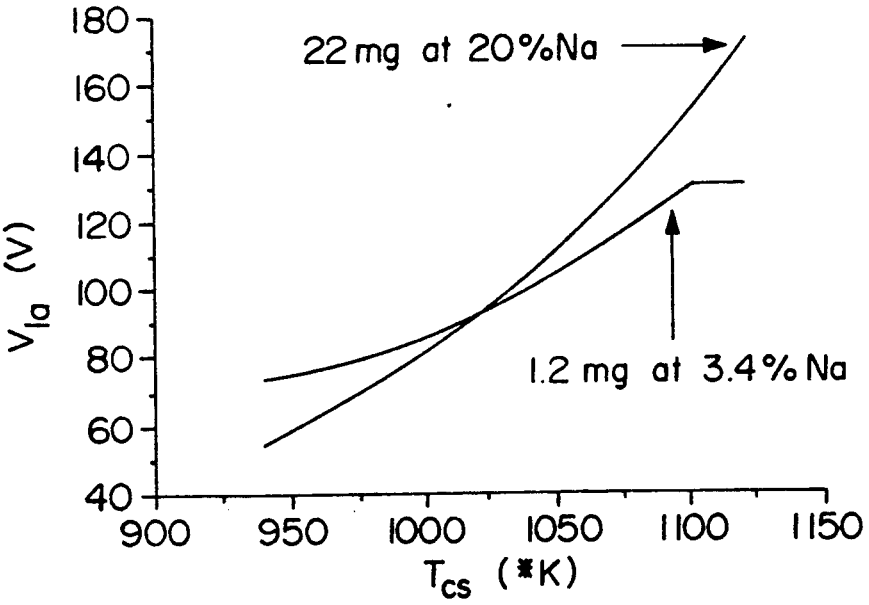
FIG. 10 is a graph of calculated lamp voltage for a lamp dosed to the current invention and for a conventional saturated lamp as a function of coldest spot temperature in the arc tube. The lamp current is 1A.

FIG. 10 shows the lamp voltage for the 70W/90V application with the above-established amalgam dosage and with the conventional dosage, calculated with equation (1) for a constant current of one ampere as a function of coldest spot temperature.

It is evident from the figure that the lamp voltage rise with coldest spot temperature is lower with the new dosage than with the conventional one, proving the better voltage stability with the sodium-saturated design.

Figure 11:
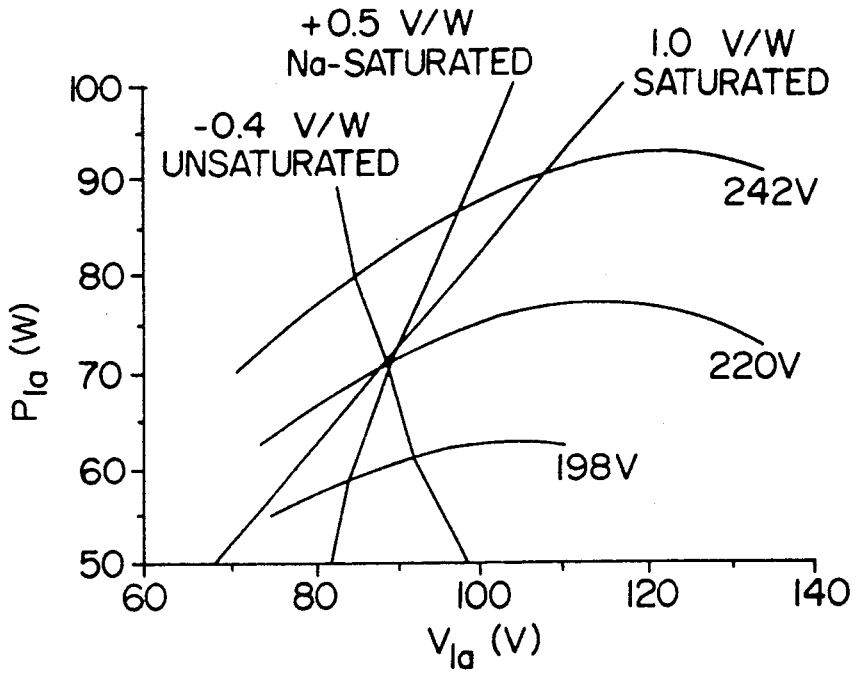
FIG. 11 is a graph of lamp power versus lamp voltage of three experimental lamps; respectively, an unsaturated vapor type, a conventional saturated vapor type, and a lamp made according to the current invention.

FIG. 11 shows a $P_{1a}-V_{1a}$ characteristic of three experimental lamps: an unsaturated vapor type lamp, a conventional saturated vapor lamp and a lamp constructed according to the invention. It is observed that the unsaturated lamp has a decreasing lamp voltage with increasing lamp power. This is due to the negative dynamic impedance of an arc lamp and is most obvious in low wattage lamps (low current). The lamp voltage of the lamp of the present invention increases with lamp power because the increase in sodium pressure overcompensates the decrease with increasing current. The absolute value of the slope of $V_{1a}-P_{1a}$ is approximately equal to the unsaturated vapor lamp. The conventional saturated vapor lamp has a higher voltage increase with lamp power because both sodium and mercury pressure rise with the increasing cold spot temperature. Hence, the new type lamp has a voltage stability with input voltage or temperature comparable to an unsaturated vapor lamp and better than a saturated vapor lamp.

Figure 12:
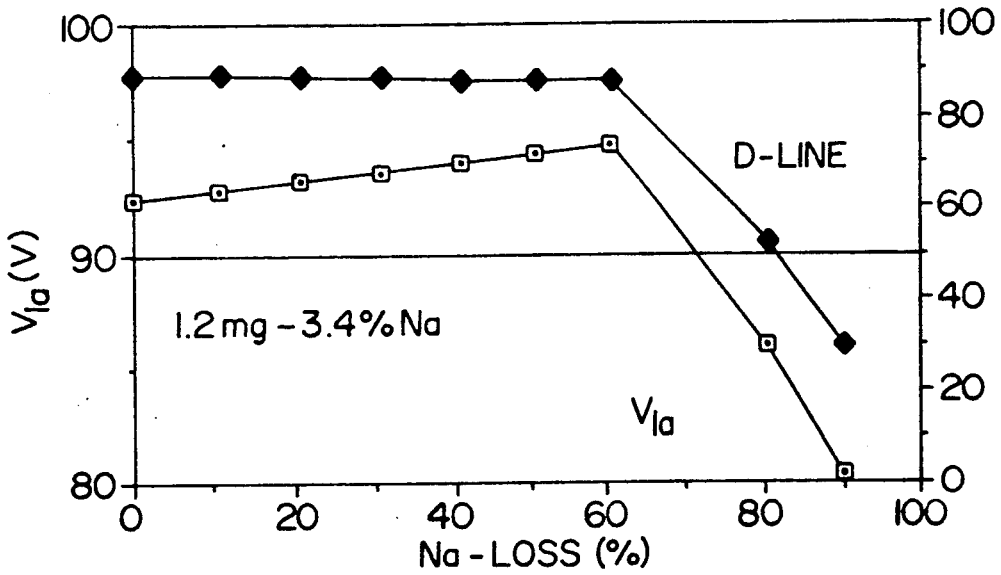
FIG. 12 is a graph of the lamp voltage and the sodium D-line reversal width as a function of sodium loss from the arc tube calculated by means of equation (1).

FIG. 12 is a graph of the lamp voltage and the sodium D-line reversal width as a function of sodium loss from the arc tube calculated using the computer program and equation (1). This graph describes the behavior in life as sodium reacts chemically and is removed from the arc. A constant cold spot temperature is assumed. It is observed that D-line and lamp voltage are very nearly constant as long as liquid sodium is left in the lamp. Once the excess sodium is depleted, the lamp is unsaturated and the D-line and voltage start dropping with more sodium is lost from the discharge. This should only occur late in the lamp life so that a constant D-line width and lamp voltage prevail during most of the lifetime.

Figure 13A:
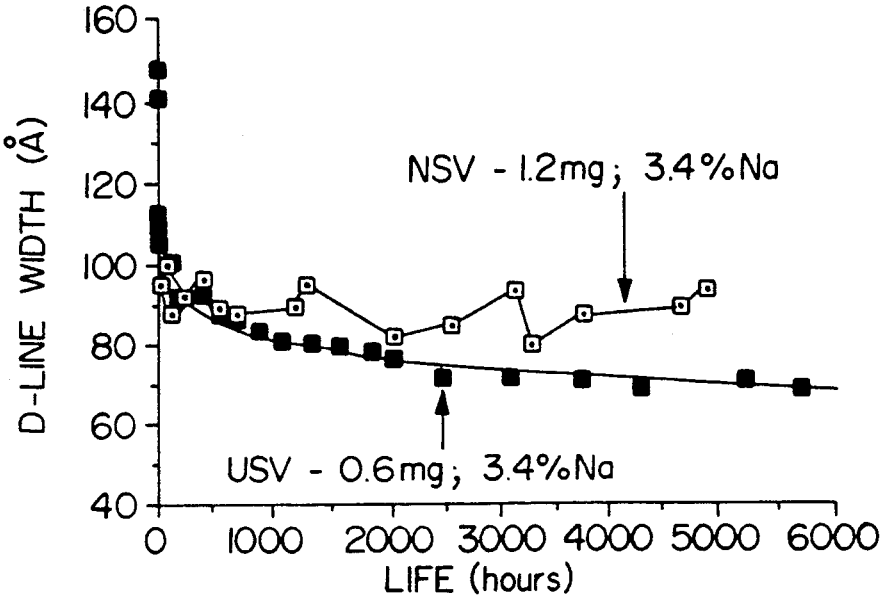
FIG. 13*a* is a graph of D-line reversal width showing burning time of unsaturated vapor versus sodium-saturated vapor.
Figure 13B:
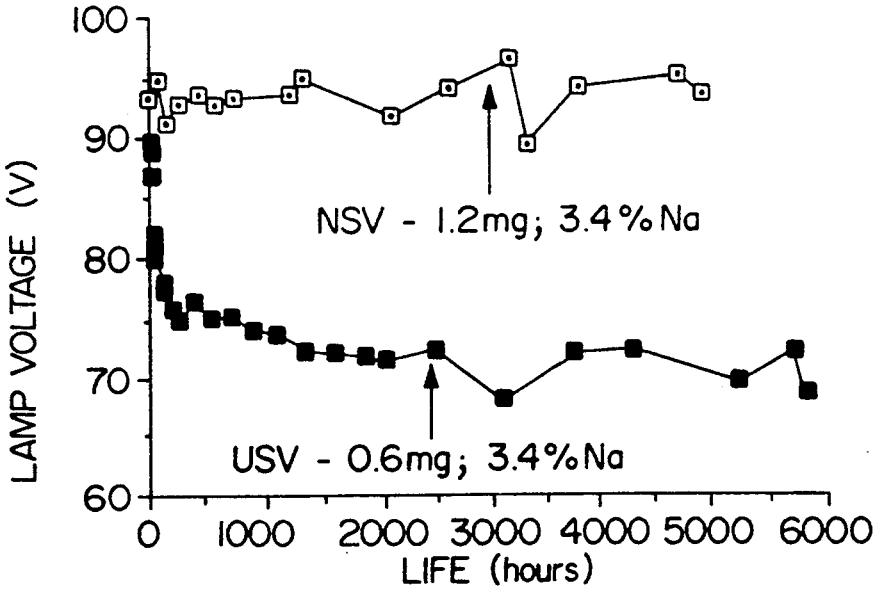
FIG. 13*b* is a graph of lamp voltage showing burning time of unsaturated vapor versus sodium-saturated vapor.

FIG. 13 compares the D-line reversal width and lamp voltage of the averages of 2 sets of experimental lamps. All lamps are made with electrodes having non-sodium-reactive emitters. The first set of 5 lamps is unsaturated vapor (0.6 mg amalgam at 3.4 weight percent sodium). The D-line width and voltage are seen to decrease with time. The second set of 3 lamps is made with the new design (1.2 mg pills at 3.4 weight percent sodium). The graph shows constant voltage and D-line as predicted by the theory outlined above.

Figure 14:
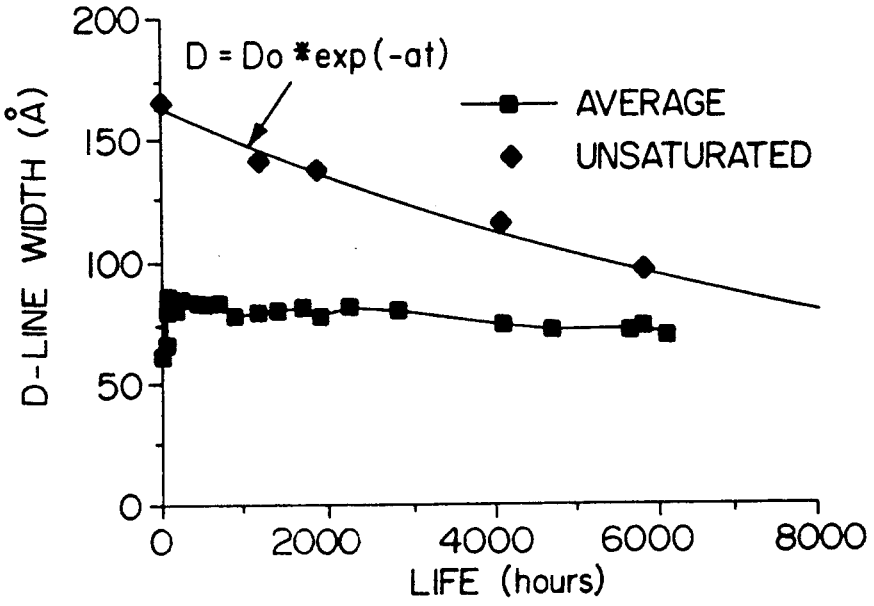
FIG. 14 is a graph of D-line reversal width versus burning time of a set of normally operating sodium-saturated lamps at normal operation and at the level of unsaturation.

A test of 6 lamps with an amalgam dosage of 0.9 mg at 3.4 weight percent sodium is also life tested. This lower pill mass is chosen because the lower (not maximized) sodium content allows easier monitoring of the sodium loss. FIG. 14 shows the average D-line width of the lamps and the average hot D-line (unsaturated D-line obtained by raising the cold spot temperature). It is observed that the latter decreases only slowly so that it is expected to stay above the operational D-line for about 8000 hours. Since the sodium content with the optimized fill of 1.2 mg at 3.4 percent sodium is still ⅓ higher (initial hot D-line 225Å), we expect that the optimized lamps will remain unsaturated in sodium during the larger part of their life.

GENERALIZATION OF THE METHOD

Approximations

In order to be able to generalize the method explained above for the case of a 70W/90V lamp, some approximations have to be made.

1. The arc length is not measured individually, but is represented by its average (nominal) value.

2. The mercury density at the operating point of the lamp is set equal to the unsaturated value. For all practical cases, this gives an error in mercury density of not more than 10 percent. Because of the square root dependence, the error in lamp voltage is even smaller.

Figure 15:
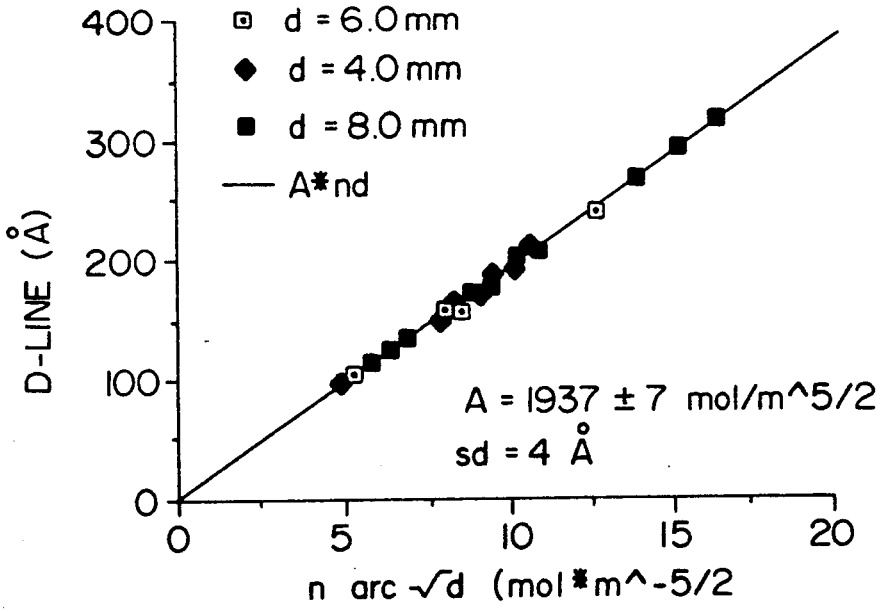
FIG. 15 is a graph of the D-line reversal width as a function of the sodium density in the arc tube times the square root of the arc tube diameter calculated for a set of diameters and sodium-to-mercury density for the application of a 360W/120V lamp.

3. The variation of D-line reversal width with mercury density is neglected and the D-line is written as:

$$D = fN\sqrt{d}$$

where N is the sodium density and d is the arc tube diameter. The proportionality factor f is determined by calculating a set of values for D and N for a range of H/N and d values used in practical high pressure sodium lamps (FIG. 15). The above-mentioned computer program was used for this purpose.

4. The sodium and mercury densities in the arc under unsaturated conditions are obtained by setting the pressures in the arc and the end well equal and using the temperatures $T_{arc}=2500K$ and $T_{ew}=1100K$ in the ideal gas law.

General Procedure

With the above approximations, a general procedure to be used in determining the optimal amalgam fill is developed and described below. The arc tube dimensions and the nominal electrical characteristics of the lamp are input to the procedure.

Step 1:

Determine the lamp voltage as a function of D-line. This can be done by dosing a lamp unsaturated and by measuring the voltage and D-line as the sodium pressure drops with increasing life. The D-line drop can be accelerated by aging the lamp at a wattage well beyond rated. The rate of change of lamp voltage with D-line width gives the constant a (in V/Å).

Step 2:

Determine the dependence of D-line corrected voltage $Y=V_{1a}-a'D$ on pill mass and on lamp current (the latter is only necessary in low wattage cases) from readings of lamps with different pill masses using the formula:

$$Y = V_o + b'\sqrt{m},$$

where m is the pill mass in mg

Step 3:

Make a set of lamps with different arc lengths and the same m/V ratio as the lamp under development. Measure the D-line width and the voltage (at a set of different currents in the low wattage case) and plot the quantity $Y=V_{1a}-a'D$ versus arc length. From a linear least square fit, the slope(s) $E_{p1}$ (in V/mm) and intercept(s) $V_{el}$ (in V) are obtained. The quantity $$V_m = 1E_{P1} - b'\sqrt{m}$$

can now be calculated. Here 1 is the arc length in mm and m is the mass in mg of the pill. If $V_{el}$ and $V_m$ are current dependent, they should be fitted linearly in $I_{1a}$; this yields $$V_m=A+B\,I_{1a}$$

$$V_{el}=C+D\,I_{1a}.$$

The results of step 3 are thus obtained:

$c = A + C$ $d = B + D$

Step 4:

Calculate the mass of the optimized pill by inserting the target values for $V_{1a}$, $1_{1a}$ and D-line in the equation:

$$m = \frac{[V_{1a} - c - dI_{1a} - a'D]^2}{b'}$$

Step 5:

Determine the target unsaturated D-line from the equation:

$$D_{Unsaturated} = \frac{V_{max} - c\,dI_{1a} - b'\sqrt{m}}{a'}$$

Here, $V_{max}$ is the maximum allowable voltage at rated input. $I_{1a}$ should such that 0.85 $V_{max}I_{1a}$ equals the rated power.

Step 6:

Determine the percent by weight of sodium in the optimized pill from:

$$\%\ \mathrm{Na} = 2.69\ 10^{-5} \times (D_{Unsaturated}/m) \times d^{3/2}\ [2.5\ l_{cav} - 1.4\ l_{arc}],$$

where $1_{cav}$ is the cavity length and $l_{arc}$ is the arc length.

The pill mass and composition have now been fixed.

Example of the General Procedure

As an example and a demonstration of the general procedure, the optimal amalgam mass and composition for a 360W/130V high pressure sodium lamp are now calculated. For this lamp an arc tube with the following characteristics is used:

$1_{arc} = 75$ mm $1_{cav} = 90$ mm $d = 8.4$ mm

Step 1:

The dependence of D-line on voltage is determined as $a' = 0.25$ V/mm.

Figure 16:
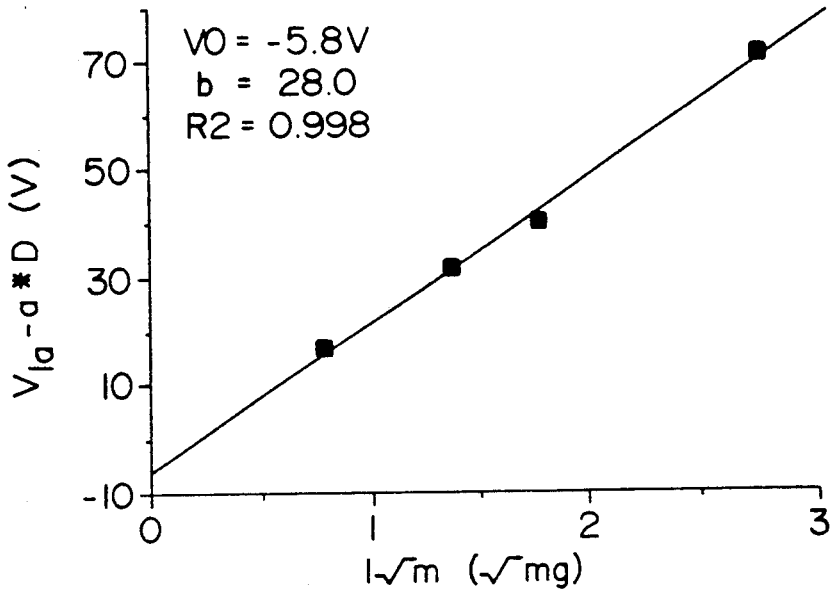
FIG. 16 is a graph of the lamp voltage VS. Hg density.

Step 2:

Lamps with different pill masses are made and measured. From a graph of $Y = V_{1a} - aD$ (FIG. 16) the coefficient b' is determined:

$$b' = 28.0\ \mathrm{V}/\sqrt{\mathrm{mg}}\ .$$

Figure 17:
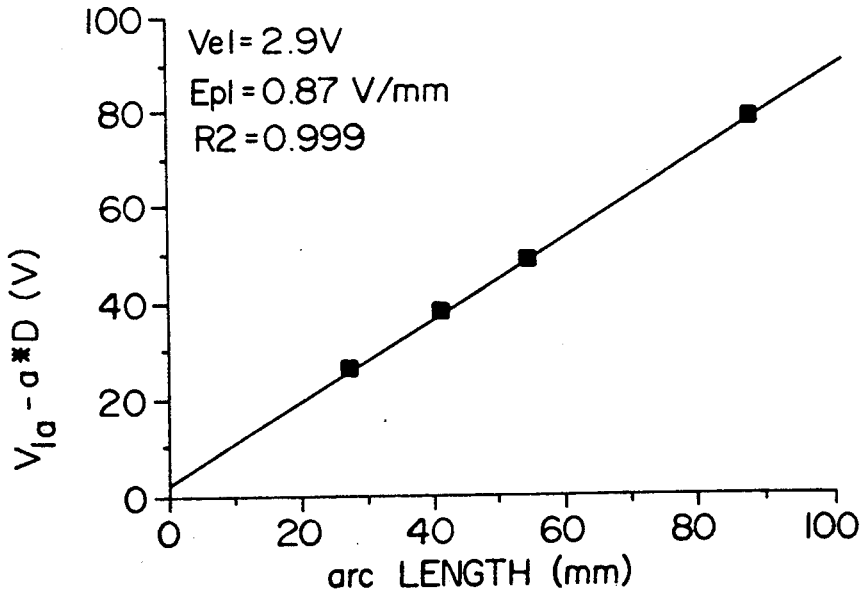
FIG. 17 is a graph of the lamp voltage of a 360W/120V lamp as a function of arc length.

Step 3:

A set of lamps with different arc lengths is made. A graph of the quantity $Y = V_{1a} - a'D$ versus arc length (FIG. 17) gives:

Epl $= 0.867$ V/mm $V_{el} = 2.9$V

We then calculate:

$$V_m = 75 \times 0.867 - 28 \times \sqrt{3} = 16.5\ \mathrm{V}$$

No current dependence of these values is observed in these high wattage lamps. Hence $B = D = 0$ and $A = V_m = 16.5$V.

So, we obtain $c = A + C = 19.4$V $d = B + D = 0$V.

Step 4:

The target values for D-line and lamp voltage are 100A and 130V, respectively. The mass of the required amalgam pill is found by:

$$m = [(130 - 19.4 - 0.25 \times 100)/28]^2 = 9.3\ \mathrm{mg}.$$

Step 5:

The maximum voltage the lamp is allowed to have is 160V. The unsaturated D-line is calculated as $$D_{Unsaturated} = (160 - 19.4 - 28 \times \sqrt{7.3})/0.25 = 260\text{Å}.$$

Step 6:

The weight percent sodium of the optimized pill can now be calculated:

$$\%\mathrm{Na} = 2.69 \times 10^{31\ 5} \times (260/7.3) \times (8.4)^{3/2} \times [2.5 \times 90 - 1.4 \times 75] = 2.8\%$$

Thus, the optimized amalgam pill for the 360W/130V application is 9.3 mg at 2.8 weight percent of sodium. At compositions lower than 3.percent sodium, the amalgam becomes soft and sticky. In order to avoid using such pills, a dosing scheme using pills of higher percent sodium together with added mercury can be applied. For instance, in the above case a pill of 5.5 mg at 4.7 percent sodium and 3.8 mg of mercury could be dosed.

According to the above, the optimal amalgam fill for a high pressure sodium discharge lamp is determined. A lamp dosed according to the invention has initially the same electrical and luminous characteristics as the lamps previously known to the art. Said lamp has about 65 percent excess sodium to compensate for sodium losses but the lamp voltage is less dependent on the coldest spot temperature and does virtually not rise with life. Beside, the maximum lamp voltage is limited so that the lamp can never extinguish and cycle.

We claim:

1. A high pressure sodium lamp for connection to an electrical power source, said lamp having a rate life at a normally operable rated input voltage and applied power, said lamp comprising an elongated arc tube having a pair of electrodes wherein said lamp has a lamp voltage across said electrodes during operation, said lamp being of the type wherein the concentration of sodium decreases during usage of said lamp over said rated life resulting in a corresponding increase in lamp voltage, each electrode being in sealing relationship with a respective end of said arc tube whereby said arc tube and said electrodes form a volume internal said arc tube, said electrodes forming a discharge path for a high emissive arc wherein said arc is extinguishable at an extinguishing lamp voltage across said electrodes, means adapted to connect said electrode to said power source for generating said arc at an applied wattage and said rated input voltage, a fill within said elongated arc tube, said fill including an inert starting gas, mercury and sodium, said mercury and sodium being present in an amount less than two milligrams per cubic centimeter of said volume of the interior of said arc tube wherein the weight rate of sodium to mercury is less than 1 to 20 whereby said lamp is saturated with said sodium and unsaturated with said mercury during lamp operation whereby said lamp voltage is maintained below said extinguishing lamp voltage at an input voltage exceeding about 90 percent of said rated input voltage.

2. A high pressure sodium lamp according to claim 1 comprising a glass envelope containing said elongated arc tube having a pair of electrodes and a plurality of electrically conductive support members, said means connecting said electrodes to a power source for generating said arc including said electrically conductive support members.

3. A high pressure sodium lamp according to claim 2 wherein said lamp remains saturated in sodium over about 50 percent of said rated life.

4. A high pressure sodium lamp according to claim 2 wherein said concentration of mercury is sufficiently low for buffering said voltage rise whereby extinction of said lamp is avoided.

5. A high pressure sodium lamp according to claim 4 wherein said applied wattage is less than 150 watts.

6. A high pressure sodium lamp according to claim 5 wherein said applied wattage from about 70 watts to about 90 watts.

7. A high pressure sodium lamp according to claim 6 wherein said sodium is present in an amount of 1.2 mg at 3.4 weight percent of sodium.

8. A high pressure sodium lamp according to claim 6 having a sodium content of about 65 percent in excess of the initial amount of sodium for saturation for compensating for sodium losses during lamp operation.

9. A high pressure sodium lamp according to claim 6 wherein said inert starting gas is xenon.

* * * * *